US008820529B2

(12) United States Patent
Kurtze et al.

(10) Patent No.: US 8,820,529 B2
(45) Date of Patent: Sep. 2, 2014

(54) FILM CONTAINER

(75) Inventors: Stephan Kurtze, Ingelheim am Rhein (DE); Stefan Lustenberger, Gensingen (DE); Rolf Kuhn, Ingelheim am Rhein (DE)

(73) Assignee: Boehringer Ingelheim International GmbH, Ingelheim am Rhein (DE)

( * ) Notice: Subject to any disclaimer, the term of this patent is extended or adjusted under 35 U.S.C. 154(b) by 372 days.

(21) Appl. No.: 13/058,248

(22) PCT Filed: Jul. 30, 2009

(86) PCT No.: PCT/EP2009/059907

§ 371 (c)(1),
(2), (4) Date: Apr. 8, 2011

(87) PCT Pub. No.: WO2010/018078

PCT Pub. Date: Feb. 18, 2010

(65) Prior Publication Data

US 2011/0266179 A1 Nov. 3, 2011

(30) Foreign Application Priority Data

Aug. 12, 2008 (EP) ..... 08162215

(51) Int. Cl.

| | |
|---|---|
| ***B65D 83/04*** | (2006.01) |
| ***B65D 50/14*** | (2006.01) |
| *A61J 1/03* | (2006.01) |

(52) U.S. Cl.

CPC ..... *B65D 83/0463* (2013.01); *B65D 2575/363* (2013.01); *A61J 1/035* (2013.01)

USPC ..... 206/531; 206/532; 206/528

(58) Field of Classification Search

CPC ..... B65D 83/0463; B65D 2575/363; B65D 2215/04; A61J 1/035

USPC ..... 206/531, 528, 532, 533, 534.1, 538, 206/428, 534.2, 536, 461, 468

See application file for complete search history.

(56) References Cited

U.S. PATENT DOCUMENTS

| | | | | |
|---|---|---|---|---|
| 5,325,968 | A | 7/1994 | Sowden | |
| 5,339,960 | A * | 8/1994 | Price | 206/531 |
| 6,394,275 | B1 | 5/2002 | Paliotta et al. | |
| 6,675,972 | B2 * | 1/2004 | Patterson | 206/531 |
| 6,708,825 | B2 * | 3/2004 | Filion et al. | 206/531 |
| 7,337,906 | B2 * | 3/2008 | Chang | 206/531 |

(Continued)

FOREIGN PATENT DOCUMENTS

| | | | |
|---|---|---|---|
| CA | 2592551 | A1 | 6/2006 |
| EP | 1674408 | A1 | 6/2006 |
| WO | 03004382 | A1 | 1/2003 |

OTHER PUBLICATIONS

International Search Report, form PCT/ISA/210, for corresponding PCT/EP2009/059907; date of mailing: Dec. 16, 2009.

*Primary Examiner* — Mickey Yu
*Assistant Examiner* — Chun Cheung
(74) *Attorney, Agent, or Firm* — Michael P. Morris; Mary-Ellen M. Devlin

(57) ABSTRACT

A film container includes a bottom film and a top film connected thereto for forming at least one accommodating chamber for a filling, in particular a pharmaceutical active substance formulation. A detachably fastened sliding element which covers the accommodating chamber is assigned to the accommodating chamber as a safeguard.

10 Claims, 2 Drawing Sheets

(56) References Cited

U.S. PATENT DOCUMENTS

Figure 1:
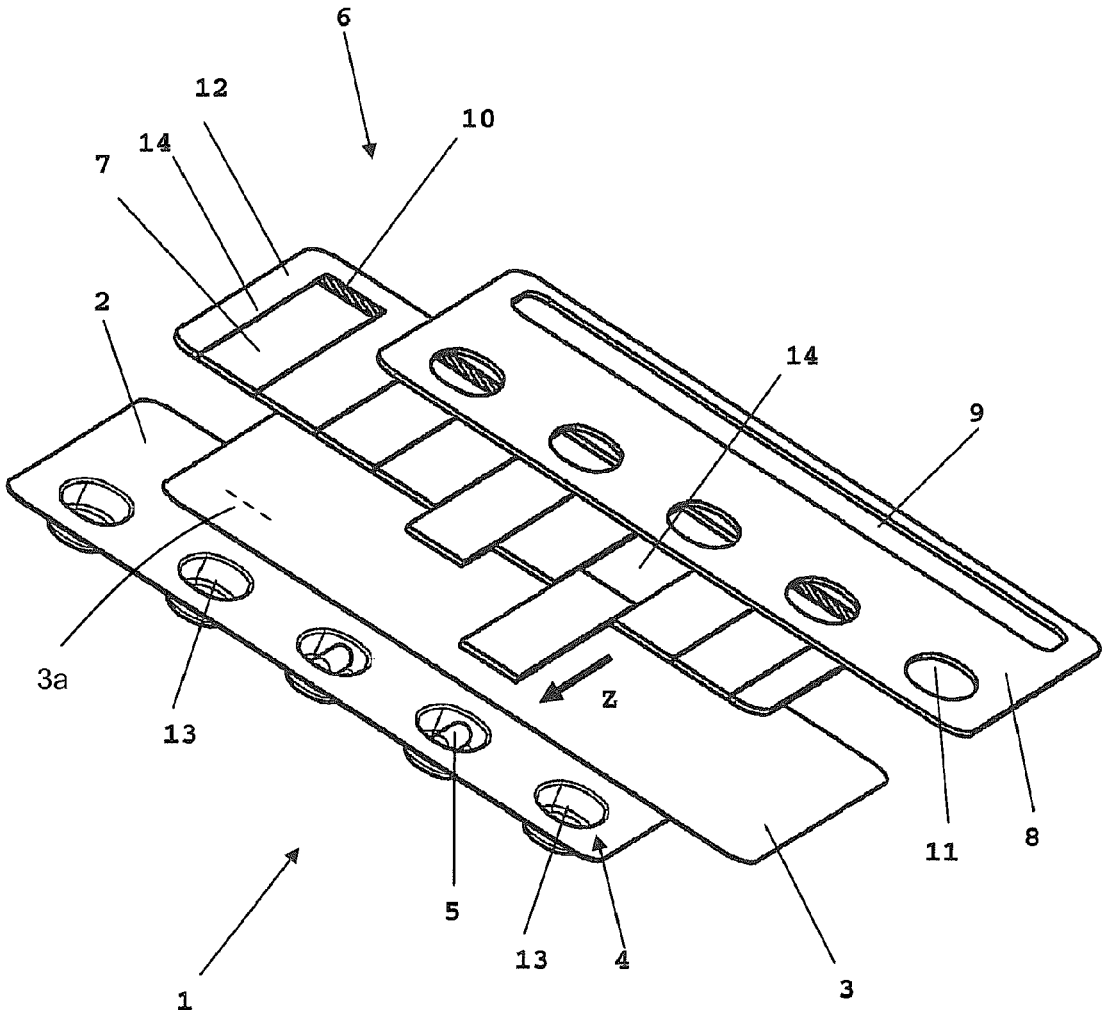

2005/0178692 A1 8/2005 Chang
2007/0084747 A1* 4/2007 Gherdan et al. ..... 206/531
2008/0110791 A1 5/2008 Specker
2010/0108677 A1* 5/2010 Loftin et al. ..... 220/265

* cited by examiner

FILM CONTAINER

The invention relates to a film container with a bottom film and a top film for forming at least one accommodating chamber for a filling, particularly a pharmaceutical active substance formulation.

Film containers are used, among other things, for protecting pharmaceutical active substance formulations from environmental effects, which in some circumstances may affect the pharmaceutical quality of the active substance formulation, and generally consist of a top film and a bottom film, with cavities for the filling provided in the bottom film. The top film and the bottom film may be made up of one or more layers of the same or different materials. The top film is attached to the bottom film in sealed manner for example by adhesive bonding, welding or sealing. The top film and/or the bottom film are generally in the form of a metal and/or plastic and/or paper film. These materials may be present in a plurality of layers. Typical metal films include for example aluminium films and composite aluminium films which are made from aluminium and a plastic, for example. The material used for the plastic films may be polyvinylchloride (PVC), cyclo-olefin-copolymer (COC), polychlorotrifluoroethylene (PCFE), polyethylene (PE), polypropylene (PP), polyethylene terephthalate (PET), polycarbonate (PC), polyester (UP), polyacrylate, polyamide (PA) or another plastic or a multi-layer composite plastic film, consisting for example of a combination of polychlorotrifluoroethylene (PCTFE), which is known particularly by the brand name Aclar® registered as a trade mark by Honeywell International, Inc., with polyvinylchloride (PVC) or polyvinyl chloride (PVC) with polyvinylidene chloride (PVdC). Often a film container or blister consists of aluminium which seals the bottom film to accommodate the pharmaceutical product or active substance. This thermoformed bottom film may also comprise an aluminium foil to prevent water from entering the cavity intended to hold the pharmaceutical product. In order to create another diffusion barrier or increase the mechanical stability of the blister, the aluminium foil of the base film, or else the top film, may optionally be covered on one or both sides with additional plastic and/or paper films.

In some states regulations on childproof packaging of medical products are being considered or are already in existence, to make it difficult for children to get hold of medicaments, in particular, which have a toxic effect or constitute a relatively serious risk to health if used inappropriately.

DE 20 2004 003 781 U1 discloses a childproof rectangular package of two films joined together, the planar closure region of which encloses at least one accommodating chamber for a filling. For opening the film container there is a physical marking, totally surrounded by the closure region, in the form of a modification, particularly an attenuation or removal of a section of the edge region. The first marking provided is an incision or a line in the closure region, which is in the form of a sealed edge region, of the package formed from the films, which does not extend to the edge of the package, and the second marking provided is a line which intersects with the first marking and which, when bent, exposes the first marking up as far as the outer contour to enable it to be torn open. The closure region is broadened in the region of an unsealed removal region to form a tab which is bent so that the incision becomes a part of the outer contour. The package is opened by tearing off an end of the package at the incision. Moreover, a rectangular bag is shown having a sealed edge which is made broader in a corner region, through which a bending line aligned diagonally with respect to the outer contour extends, from which an incision or punched marking proceeds at right angles for tearing the package open.

The problem of the invention is to provide a foil container of the type described hereinbefore, wherein a filling contained individually in the accommodating chamber is contained therein so as to be extremely reliably childproof.

The problem is solved according to the invention in that the accommodating chamber is associated with a releasably fastened sliding element that covers the accommodating chamber as a safeguard.

The film container, a so-called blister, is essentially formed by the bottom film comprising the cavities and the top film through which the filling has to be pressed in known manner. Additionally, the film container comprises sliding elements which are associated with each individual accommodating chamber as sliding elements to be actuated separately. The sliding element is disposed above the accommodating chamber in a first secured position and can be slid or pulled into a second position for the removal of the filling, so as to expose the area above the accommodating chamber, after which the top film is visible and the filling can be pressed out of the accommodating chamber through the top film. The sliding element may be arranged on or movably fastened to the film container in any desired manner. Thus, for removing the filling through the top film, first of all the sliding element has to be moved so as to expose the corresponding region of the top film.

As an additional separate securing device in the form of the sliding element is provided for each accommodating chamber, this constitutes an additional childproof lock for the film container, as the method of opening the accommodating chamber is unusual and therefore difficult for a child. An adult, on the other hand, can easily grasp and carry out the processes for opening the accommodating chamber. The sliding element may be made from an inexpensive material and if it is suitably designed there is no need for an additional outer wrapper, as the film container forms a unit with its outer wrapper. The various steps needed to open the accommodating chamber moreover effectively prevent unintentional removal of the filling and the accommodating chamber is protected by the sliding element in its opening region.

Preferably, each sliding element has a perforated opening tab in its operative region or is covered by an opening tab, the opening tab having to be opened or removed in order to move the sliding element. Accordingly, the opening tab first of all has to be opened along its perforation or removed, to give access to the sliding element and enable the latter to be moved from its position covering the accommodating chamber into its position exposing the opening of the accommodating chamber. Thus, the film container cannot be opened automatically, or in a manner that is simple for a child. The opening tab may for example be formed in one piece with the sliding element and equipped with corresponding perforations during the manufacture of the film container. Of course, the opening tab may also be secured by gluing, for example.

According to one feature, in the region of the accommodating chamber the top film is in the form of a tear-off and/or tear-open tab, or an additional tear-off and/or tear-open tab may be provided. The tear-off and/or tear-open tab prevents the filling from simply being pressed through the top film. Instead, in order to remove the filling, after the sliding element has been moved, the tear-off and/or tear-open tab has to be removed or opened. This tear-off and/or tear-open tab may be constructed for example as a film layer of the top film during the production of the multi-layer film container or may cover the bottom film and/or the top film as an additional film in the region of the accommodating chamber and may be suitably attached to the bottom film and/or the top film, for example by gluing.

Preferably, the sliding element is combined with a flat section in which the sliding element is mounted, to form a safety element. The safety element can be handled separately from the film container and is to be attached firmly to the film container, namely the blister, depending on the filling or the safety and/or handling requirements.

The flat section is of substantially the same size as the bottom and top films, so as to cover the top film completely and form an additional layer, in the case of a multi-layer film container. The sliding element can be moved along in the plane of this layer after the pre-perforated opening tab has been opened or torn off.

In order to enable a plurality of sliding elements to be arranged side by side and provide a technically relative simple mounting, the sliding element is conveniently rectangular in shape and the flat section has a corresponding recess for accommodating the sliding element. Of course, the recesses are open at the edges to enable the sliding elements to be moved along.

According to a further feature, the safety element comprises a cover that covers the flat section, this cover having a slot through which the opening tab of the sliding element is accessible and being provided with an opening the geometry of which essentially corresponds to the ground area of the accommodating chamber and which is arranged so as to correspond to the accommodating chamber. Thus, the sliding elements are retained between the top film and the cover in the flat section so as to be incapable of being lost. The cover prevents manipulation of the movable sliding elements arranged under the cover. If desired, the sliding elements may project slightly beyond the film container in the lateral direction, in order to move the sliding element along after the pre-perforated opening tab has been opened and thus expose the accommodating chamber. The sliding element may either be pushed along until it reaches a stop or removed from the film container completely.

The slot is provided in the cover for the purpose of actuating various pre-perforated opening tabs. It is possible to gain access to the opening tabs through this slot. Naturally, each opening tab may have its own separate slot or a plurality of opening tabs may be associated with a common slot, for example in the form of an elongated hole. The filling is removed through the opening in the cover. Obviously, another safety film may be associated with the cover, for example as evidence that the safety element has not been tampered with.

To save additional packaging material, the cover is configured as a wrapper or part of a wrapper. There is no need for an additional cardboard box, for example. All the necessary product information can also be printed on this wrapper to obviate the need for an information leaflet within the pack.

Preferably, the bottom film is made of plastics, aluminium or a combination of these materials. The shape, size and number of the various cavities of the accommodating chambers in the bottom film are adapted to the filling that is to be placed therein, such as a tablet or the like, for example. Naturally, a single film container may be configured with 5, 10, 20 or 30 accommodating chambers each having an associated sliding element. The bottom film is produced, for example, on the side facing the filling, from a layer of polyvinylchloride (PVC) approximately 60 μm thick, followed by an aluminium film roughly 45 μm thick, which is in turn attached to a film of an oriented polyamide (oPA) roughly 25 μm thick.

A proposed material for the top film is a composite aluminium film, while in order to remove the filling, as explained hereinbefore, the user presses the filling out of the accommodating chamber and through the top film, or tears the top film open above the opening of the accommodating chamber. For opening the accommodating chamber, corresponding markings, perforations and the like may be provided on the top film. The top film may consist, for example, on the side facing the filling, of an aluminium film roughly 20 μm thick and attached thereto a film, roughly 23 μm thick, of a polyethylene terephthalate (PET). Obviously, the bottom film and the top film may also be identical or made from other materials.

In an advantageous embodiment, the material for the sliding element and/or the cover and/or the flat section is board or cardboard. These materials can be processed relatively easily by stamping, embossing and/or printing. The sliding element with the associated pre-perforated opening tab is combined to form one part in the flat section during production and is provided with the corresponding punched designs or perforations. During the manufacture of the film container, a layer of this kind may be glued to the top film, for example.

Advantageously, the film container is equipped with a packaging unit resembling a wallet. A so-called wallet pack is a combination of a film container, i.e. a blister pack, and a folding carton. A wallet pack of this kind can be flipped open and closed in the manner of a wallet. It consists of one or more blister cards which are fixedly attached to a secondary packaging, e.g. of folded cardboard. The blister cards may for example be glued, sealed or riveted to the secondary packaging or attached by stickers. The wallet may be subdivided into different numbers of cardboard layers (panels). Information in the form of a booklet may be enclosed in the wallet or attached thereto (e.g. by gluing, sealing or fixed with stickers).

It will be understood that the features mentioned above and about to be explained hereinafter may be used not only in the particular combination specified but also in other combinations. The scope of the invention is defined only by the claims.

Figure 2:
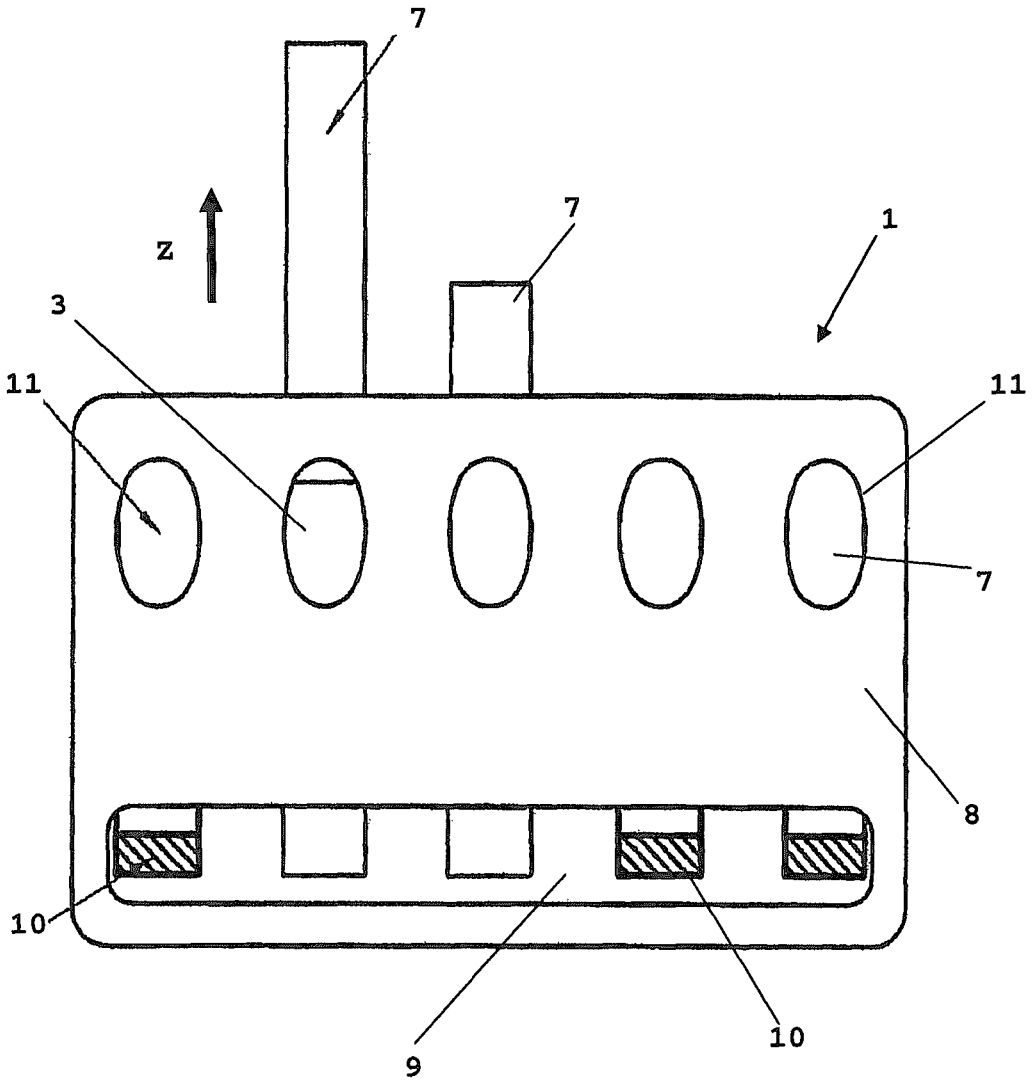

The invention is hereinafter explained in more detail by means of an embodiment by way of example, with reference to the associated drawings, wherein:

FIG. 1 is an exploded perspective view of a film container according to the invention and FIG. 2 is a plan view of the film container according to FIG. 1.

The film container 1 in the form of a blister or blister pack comprises a bottom film 2 with cavities 13 and a top film 3, which is attached to the bottom film 2 in suitable manner, preferably using a heat-seal lacquer, to form closed accommodating chambers 4 in the region of the cavities 13, each for at least one filling 5, particularly a pharmaceutical active substance formulation.

In addition, the film container 1 has a safety element 6 which comprises a flat section 12 made of board or cardboard, in which sliding elements 7 are each mounted in a recess 14 and can be pulled out manually from the flat section 12 in the direction of the arrow Z. To prevent damage to the sliding elements 7 and retain the sliding elements 7 in the flat section 12 so that they cannot be lost, a cover 8, particularly of board or cardboard, is provided, which projects over the flat section 12 and which has a slot 9 in the edge region opposite the accommodating chambers 4, through which it is possible to gain access to pre-perforated opening tabs 10 of the sliding elements 7 which are aligned parallel and at a spacing from one another. Opposite the slot 9 there are openings 11 in the cover 8, through which the filling 5 can be removed.

In order to open an accommodating chamber 4 of the film container 1, first of all the pre-perforated opening tab 10 has to be gripped through the oblong slot 9 and pulled away or torn off, to enable the sliding element 7 first of all to be slid out of the flat section by reaching through the slot 9 or the opening 11 of the cover 8 in the direction indicated by the arrow Z, so that the top film 3 is exposed in the region of the corresponding accommodating chamber 4. Then the filling 5 can be pressed out of the accommodating chamber 4 through the cover film 3 and removed through the opening 11 in the cover 8.

In the region of the accommodating chamber 4 the top film 3 is in the form of a tear-off and/or tear-open tab, or an additional tear-off and/or tear-open tab 3*a*. The tear-off and/or tear-open tab 3*a* prevents the filling 5 from simply being pressed through the top film 3. Instead, in order to remove the filling 5, after the sliding element 7 has been moved, the tear-off and/or tear-open tab 3*a* has to be removed or opened. This tear-off and/or tear-open tab 3*a* may be constructed for example as a film layer of the top film 3 during the production of the multi-layer film container 1 or may cover the bottom film 2 and/or the top film 3 as an additional film in the region of the accommodating chamber 4 and may be suitably attached to the bottom film 2 and/or the top film 3, for example by gluing.

A stop may be provided to limit the withdrawal of the sliding element 7, or the latter may be pulled out completely and removed from the film container 1.

The invention claimed is:

1. A film container, comprising:

a bottom film;

a top film attached to the bottom film to form at least one accommodating chamber for a filling;

a respective releasably attached sliding element associated with, overlying, and covering respective ones of the at least one accommodating chamber, where each sliding element includes: (i) a sliding member of elongate configuration in a lateral direction, and in sliding relationship to the respective accommodating chamber in the lateral direction, (ii) a grasping portion disposed on one lateral end of the sliding member, and (iii) a perforated opening tab disposed at an opposite lateral end of the sliding member;

a flat section in which the respective sliding elements are mounted, to form a safety element; and a cover that covers the flat section, has a slot through which the perforated opening tab of the sliding element is accessible, and has an opening that corresponds to a base area of the accommodating chamber, wherein the perforated opening tab must be removed in order to displace the sliding element in the lateral direction by grasping the grasping portion and pulling away from the location of the perforated opening tab in order to access the associated accommodating chamber.

2. The film container according to claim 1, wherein the perforated opening tab is formed in one piece with the sliding element.

3. The film container according to claim 1, wherein in the region of the accommodating chamber the top film is configured as a tear-off and/or tear-open tab or an additional tear-off and/or tear-open tab.

4. The film container according to claim 1, wherein the sliding element is rectangular in shape and the flat section has a corresponding recess for accommodating the sliding element.

5. The film container according to claim 1, wherein the cover is configured as a wrapper or part of a wrapper.

6. The film container according to claim 1, wherein the bottom film is made of plastics, aluminium or a combination of these materials.

7. The film container according to claim 1, wherein the top film is a composite aluminium film.

8. The film container according to claim 1, wherein the sliding element and/or the cover and/or the flat section is formed from board or cardboard.

9. The film container according to claim 1, wherein the film container is equipped with a wallet-like packaging unit.

10. The film container according to claim 1, wherein the filling is a pharmaceutical active substance formulation.

* * * * *